US008887865B2

(12) United States Patent
Matharu

(10) Patent No.: US 8,887,865 B2
(45) Date of Patent: Nov. 18, 2014

(54) DEVICE OF ASSISTANCE FOR A USER OF A LADDER

(75) Inventor: Kamay Matharu, Markham (CA)

(73) Assignee: Tractel Limited, Scarborough, Ontario (CA)

( * ) Notice: Subject to any disclaimer, the term of this patent is extended or adjusted under 35 U.S.C. 154(b) by 824 days.

(21) Appl. No.: 12/718,259

(22) Filed: Mar. 5, 2010

(65) Prior Publication Data

US 2011/0214940 A1 Sep. 8, 2011

(51) Int. Cl.

| | |
|---|---|
| ***A62B 1/16*** | (2006.01) |
| ***E06C 7/18*** | (2006.01) |
| ***E06C 7/00*** | (2006.01) |

(52) U.S. Cl.

CPC ..... *E06C 7/186* (2013.01); *E06C 7/003* (2013.01)

USPC ..... 182/8

(58) Field of Classification Search

USPC ..... 182/19, 3, 8, 10, 18, 73, 230

See application file for complete search history.

(56) References Cited

U.S. PATENT DOCUMENTS

| | | | | |
|---|---|---|---|---|
| 4,380,796 | A * | 4/1983 | Ostby | 700/169 |
| 7,634,825 | B2 * | 12/2009 | Chepurny et al. | 5/83.1 |
| 7,798,288 | B2 * | 9/2010 | Blasek | 182/42 |
| 7,987,945 | B2 * | 8/2011 | Petersen | 182/8 |
| 2002/0025888 | A1 * | 2/2002 | Germanton et al. | 482/1 |
| 2002/0043510 | A1 * | 4/2002 | Bachman et al. | 212/283 |
| 2007/0004567 | A1 * | 1/2007 | Shetty et al. | 482/69 |
| 2007/0158137 | A1 | 7/2007 | Petersen | |
| 2009/0249712 | A1 * | 10/2009 | Brickell et al. | 52/173.1 |
| 2010/0219016 | A1 * | 9/2010 | Meillet | 182/8 |
| 2011/0048853 | A1 * | 3/2011 | Brickell | 182/5 |

FOREIGN PATENT DOCUMENTS

| | | |
|---|---|---|
| DE | 261525 | 11/1988 |
| DE | 20216895 U1 | 1/2003 |
| EP | 1277495 A1 | 1/2003 |
| EP | 1319796 A1 | 6/2003 |
| FR | 2440906 A1 | 6/1980 |
| WO | 03/071083 A1 | 8/2003 |
| WO | 2009/126541 A1 | 10/2009 |

OTHER PUBLICATIONS

International Search Report, dated Nov. 18, 2010, in PCT/IB2010/000492.

* cited by examiner

*Primary Examiner* — Katherine Mitchell
*Assistant Examiner* — Candace L Bradford
(74) *Attorney, Agent, or Firm* — Young & Thompson

(57) ABSTRACT

In a ladder assistance device, a cable pulled by a controlled driving apparatus is laid in a loop along the height of the ladder, the user being attached to the cable by a lanyard, a sensor element detecting movements along the ladder, a control element controlling the driving apparatus. A remote control activates or deactivates assistance and allows user weight input, the remote control remaining in the reach of the user and including a stop button deactivating assistance and two activation buttons for activation of assistance, one each for "up"/"down". A memory stores sets of control values for assistance level(s) for each direction of movement, corresponding to at most two levels in the steady state of the assistance. The program of the control element allowing: the selection that corresponds to the user weight, the activation which is only obtained by the activation buttons of the remote control.

20 Claims, 3 Drawing Sheets

DEVICE OF ASSISTANCE FOR A USER OF A LADDER

BACKGROUND OF THE INVENTION

1. Field of the Invention

The present invention relates to a device of assistance (=assistance device) for a user of a ladder. It is intended to provide a pulling force to a user who is climbing along a ladder or any other kind of climbing device of the same type. It is particularly useful in windmills, towers, chimneys or other constructions which needs maintenance by users who, most of the time, have also tools to carry up. Thanks to such an assistance device, the user feels a reduced weight while the device is providing assistance. This assistance can also be effective while the user is descending.

2. Description of the Related Art

Such devices are usually made of a traction rope which is looping between the two ends of the ladder and which is driven by a driving means such as an electric motor. The user hangs himself with a safety harness to the traction rope and he is thus pulled by the device but with a pulling force which is always less than the gravity force due to his weight.

Such devices are already known. For example, FR 2.440.906 for "Rampe mobile du type ascenseur ou descenseur á commande par traction sur I'élément formant rampe" is an assistance device which is operated according to the tension which is exerted on the traction rope as to switch on/activate or off/deactivate the assistance. PCT international application WO2009/126541 refers to a "tower climbing assist device" in which a load sensor is attached to the person on the lanyard connecting him to the traction rope. Application WO2003/071083 for "ladder climbing assistance device" in which an assistance device has a freely suspended weight-loaded wheel tightening the traction rope. Application WO2005/088063 for "Method for regulating the traction in a line of a ladder, climbing assistance device and ladder climbing assistance device" in which the activation and the deactivation of the assistance is a function of the result of detection or not of movements of the traction rope during predetermined periods of time. In this last device, displacements of the user results in movements of the traction rope which is sensed and when a movement is sensed for a certain period of time the assistance is activated to a predetermined high level of traction and while movements are sensed for a predetermined period of time, the traction remains activated at that predetermined high level of traction. On the contrary, when activated, if no movement is sensed for a predetermined period of time, the device is deactivated or the traction reduced to a low level.

All those known devices have some drawbacks. One of them is that the detection of movements or tension of the rope is not necessarily an indication to the real intention of the user to start moving along the ladder. For example he could have to bend himself or move only one or two steps to manipulate or open or close a trap door which is arranged along the ladder for security reasons. This could be the same for the recovering of his tools which could be hanging, attached to him in a tool bag or magnetically removably attached to a metallic part of the ladder while he his working along the ladder for example. If the sensing of movement of the traction rope is implemented, even for a certain period of time, the user will get the assistance even if he does not want it.

In addition, even if the real intention of the user could be known and the assistance device activated accordingly, at the beginning (or even at the end) of user activity, it is not certain that this is for climbing the whole ladder (or to really stop). As seen, a door may be found at the lower end (at some height) or the upper end (as a removable platform) of the ladder. As a consequence, giving a full assistance from the start of activation or deactivating the assistance when the user stops moving is not necessarily a good thing. It would be preferable to start assistance with a lower level of assistance before going to a higher level of assistance and, possibly, to decrease from higher assistance to a lower level of assistance before a possible deactivation.

SUMMARY OF THE INVENTION

The assistance device of the invention is intended to overcome shortfalls of known assistance devices and/or provide advantages to the user of assistance devices.

Accordingly, the current invention relates to a device of assistance for a user of a ladder, a cable pulled by a controlled driving apparatus being laid in a loop along the height of the ladder, the user being attached to said cable by a lanyard, a sensor means disposed in the driving apparatus allowing to detect movements of ascension or descent of the user along the ladder, a control means with a determined control program connected to the sensor means controlling the driving apparatus of the cable according to the movements of the user so that when the device is assisting the user, the driving apparatus drives the cable with determined assistance levels corresponding to pulling forces for the user which are lower than the force of gravity of the weight of said user.

According to the invention:

the device further comprises:

a remote control for activation or deactivation of the assistance and also allowing the manual input of the weight of the user, the remote control remaining in the reach of the user, the remote control being preferably attached to the lanyard, the remote control comprising a stop button for the deactivation of assistance, when deactivated no assistance being provided, and two activation buttons for the activation of the assistance, one for selecting "up" direction for when the person wants an assistance on climbing and one for selecting "down" direction for when the person wants an assistance on descent, and in that the device, preferably in the control means, comprises a memory for storage of sets of control values for the control of the assistance level(s) of the driving apparatus by the control means, the assistance level(s) for each direction of movement, up or down, corresponding to at most two levels in the steady state of the assistance, each set of control values being for a given weight of the user and having for an "up" direction selection two control values, a base control value for an "up" selection, a nominal control value for an "up" selection, the base control value giving a lower assistance level to the user than the nominal control value, the lower assistance level being not null, the program of the control means having material means for allowing:

the selection among the sets of the one that corresponds to the weight of the user entered in the control means with the remote control, the activation which is only obtained by the activation buttons of the remote control, the activation buttons allowing the start of assistance to a level set to the base control value for the selected direction, the deactivation which is obtained by either the stop button of the remote control, or by the detection by the sensor of no movements of the user, or by the detection by the sensor of an actual direction of movement of the person opposite to the activation button which was selected by the person.

In various embodiments of the invention, the following means are used, either alone or in any technically possible combination:

the program of the control means allows in addition deactivation of the assistance when the person, after having selected a button for a given direction and thus activated the assistance device, selects the opposite direction button, the device, preferably in the control means, comprises a memory for storage of sets of control values for the control of the assistance level(s) of the driving apparatus by the control means, the assistance level(s) for each direction of movement, up or down, corresponding to two levels in the steady state of the assistance, each set of control values being for a given weight of the user, the two levels for each selected direction being given by a base control value and a nominal control value, the base control value giving a lower assistance level to the user than the nominal control value, the lower assistance level being not null, each set thus having four control values, and in that the program of the control means allows for each direction selection:

following a predetermined time after the level assistance has been set to the base control value, if the sensor detects a movement of the user in the selected direction then the level of assistance is set to the nominal control value else being the deactivation of the assistance, when the level assistance has been set to the nominal control value, if the sensor detects no movement or a slow movement of the user then the level of assistance is set to the base control value, the level of assistance, for each given weight, given by the up base control value is equal to the one given by the down base control value, the up base control value being equal to the down base control value, the level of assistance, for each given weight, given by the up nominal control value is equal to the one given by the down nominal control value, the up nominal control value being equal to the down nominal control value, in the case, for each given weight, the base control values for both direction are equal, only one base control value is stored, in the case, for each given weight, the nominal control values for both direction are equal, only one nominal control value is stored, the device, preferably in the control means, comprises a memory for storage of sets of control values for the control of the assistance level(s) of the driving apparatus by the control means, the assistance level(s) for the selected "up" direction corresponding to two levels in the steady state of the assistance for the climbing of the person, the assistance level for the selected "down" direction corresponding to one level in the steady state of the assistance for descent of the person, each set of control values being for a given weight of the user, the two levels for the selected "up" direction being given by an up base control value and an up nominal control value, the up base control value giving a lower assistance level to the user than the up nominal control value, the lower assistance level being not null, each set thus having four control values, the level for the selected "down" direction being given by a down main control value, and in that the program of the control means allows for the "up" selected direction:

following a predetermined time after the level assistance has been set to the up base control value, if the sensor detects a movement of the user in the up selected direction then the level of assistance is set to the up nominal control value else being the deactivation of the assistance, when the level assistance has been set to the up nominal control value, if the sensor detects no movement of the user then the level of assistance is set to the up base control value, and in that the program of the control means allows for the "down" selected direction:

when the level assistance has been set to the down main control value, if the sensor detects no movement of the user then the assistance is deactivated, the level of assistance, for each given weight, given by the up base control value is equal to the one given by the down main control value, the up base control value being equal to the down main control value, the level of assistance, for each given weight, given by the up nominal control value is equal to the one given by the down main control value, the up nominal control value being equal to the down main control value, in the case, for each given weight, the up base control value is equal to the down main control value, only one of them is stored, in the case, for each given weight, the up nominal control values is equal to the down main control value, only one of them is stored, the assistance level given by the up nominal control value is approximately 75% of the entered weight for the heaviest users and approximately 45% for the lighter ones, preferably, the assistance level given by the up nominal control value is approximately 65% of the entered weight for the heaviest users and approximately 60% for the lighter ones, the control means comprises means allowing to gradually modify, =ramping, over a first predetermined time the action of the driving apparatus at least at start of assistance and when the control values change between up base and up nominal control values, the control means comprises means allowing to gradually modify over a second predetermined time the action of the driving apparatus when the assistance device is deactivated, the deactivation is also obtained by the detection by the sensor of an excessive movement of the user corresponding to an over speed of the cable, the driving apparatus comprises the electric motor, a gear drive, a pulley, the sensor and the control means, the sensor is a rotational sensor for detection of the rotation (or no rotation or a slow rotation) of the pulley or of the motor shaft of the driving apparatus, the rotational sensor gives binary pulses which time characteristics are in relation to the rotation of the pulley or motor shaft of the driving apparatus, said rotational sensor being preferably a switch activated by a toothed path of the pulley or motor shaft, the driving apparatus comprises the electric motor, a gear drive, a pulley, the sensor and the control means, the sensor is a rotational sensor for detection of the rotation (or no rotation or a slow rotation) of the pulley or motor shaft of the driving apparatus, said the rotational sensor giving binary pulses which time characteristics are in relation to the rotation of the pulley or motor shaft of the driving apparatus, said rotational sensor being preferably a switch activated by a toothed path of the pulley or motor shaft, the control means are detachable from the driving apparatus, the driving apparatus is detachable from the ladder, preferably, the pulley driven by the motor remains fixed to the ladder, the control means are in the driving apparatus which is detachably attached to the ladder, the driving apparatus is disposed at one end of the ladder, the other end of the ladder having a pulley which is detachably attached to it, the remote control has a display means, the remote control has a wireless transmitting means to the control means, the control means having a wireless receiving means, the remote control has active means for allowing the entry by the user of his weight, the remote control having a display for displaying weights for a selection of his weight, and the remote control has means for sending to the control means the finally selected weight, the remote control is passive and, in addition, the remote control has a wireless receiving means for data from the control means, the control means having a wireless transmitting means and the remote control has a display for displaying to the person at least part (display data) of the data transmitted by the control means, said part of the data being weights to display on the remote control display, the wireless exchanges between the remote control and the control means are by radio waves or infrared, the remote control and possibly the control means, has/have active means for, when the stop button and one of the two activation buttons are both pressed, displaying on the remote control a numerical value corresponding to a weight, the displayed value increasing or decreasing when the "up" or "down" button respectively is pressed while the stop button is kept pressed, the last value displayed when at least the stop button is released being the selected weight, the remote control has a display means and that the device has active means for, when the stop button and one of the two activation buttons of the remote control are both pressed, displaying on the remote control a numerical value corresponding to a weight, the displayed value increasing or decreasing when the "up" or "down" button respectively is pressed while the stop button is kept pressed, the last value displayed when at least the stop button is released being the selected weight, the motor is a DC or AC or step motor.

BRIEF DESCRIPTION OF THE DRAWING FIGURES

The present invention will now be exemplified by the following description of embodiments, without being limited thereto, with reference to the attached drawings in which.

DETAILED DESCRIPTION OF THE INVENTION

Figure 1:
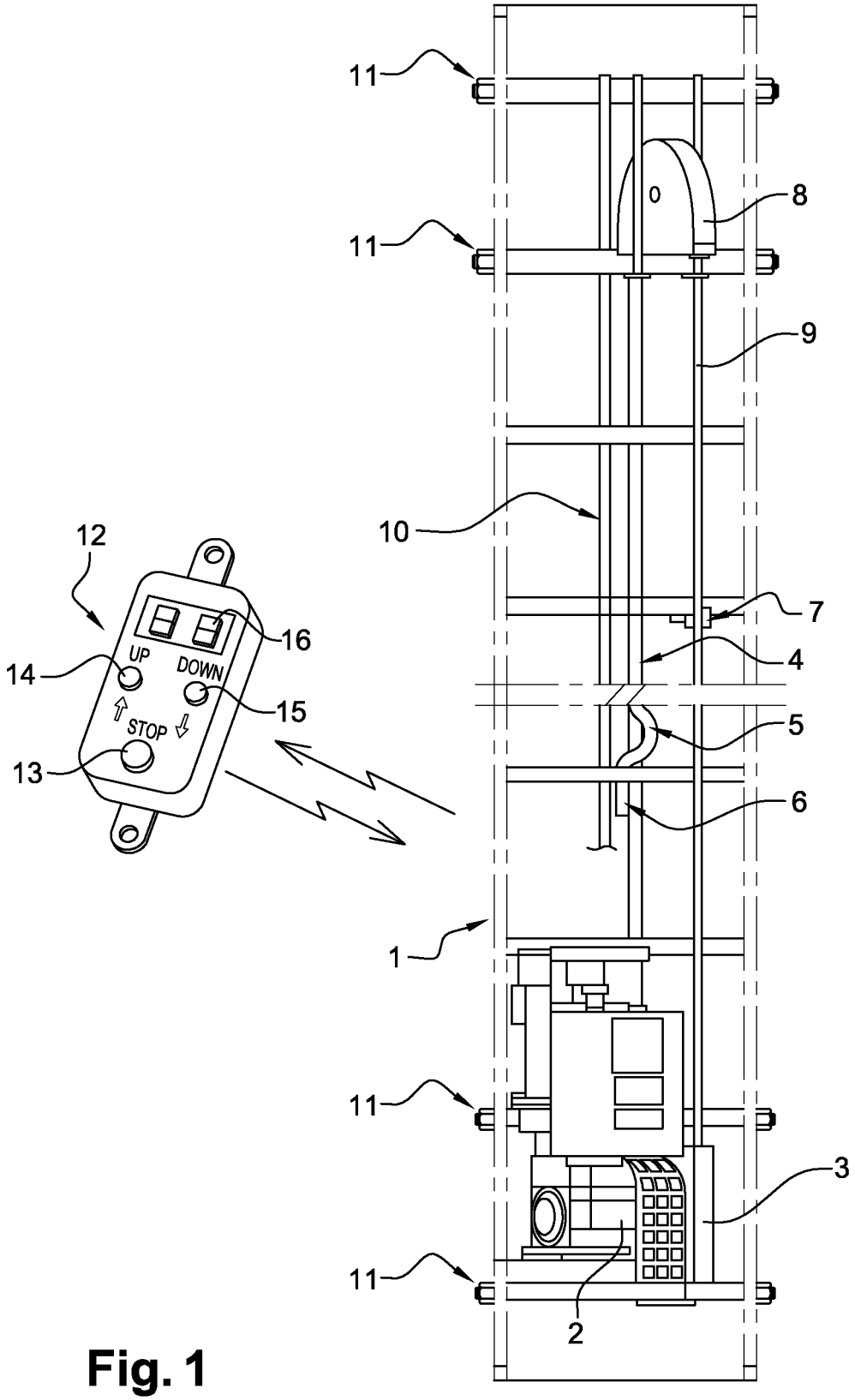
FIG. 1 is a rear view of the assistance device implemented on a ladder.

On FIG. 1, a ladder 1 is equipped with an assistance device. As usual, the user wears an approved safety harness. The assistance device is essentially made of a driving apparatus 2 attached to the ladder at its lower end, of an upper pulley attached at the upper end of the ladder and of a traction cable 4, 9 looping around the ladder between a bottom pulley 3 of the driving apparatus 2 and the upper pulley 8. A remote control 12, and which is normally attached to the user to be readily accessible to the user, more specifically to the lanyard between the user and a carabineer 6 of a belt grab 5 attached to the cable, is also part of the assistance device. In other embodiments, the remote control can be attached to other parts of the equipment in relation to the user so as to be also reachable by the user. The belt grab is attached to the climb side 4 of the cable located on the front side of the ladder (opposite to the ladder on this rear view). On the rear side of the ladder (side of this rear view) the rear side of the cable may be guided by guiding device(s) 7 if required. An independent life line 10 must be available. According to applications, threaded rod and hardware 11 reinforce the ladder. The assistance device can be implemented on ladders for up to 100 meters high for example. In other embodiments, the driving apparatus 2 is attached on the other side of the ladder.

Preferably, the driving apparatus 2 is attached to the lower end of the ladder in a detachable manner as to use the same driving apparatus on different ladders by displacing it and installing it on the ladder which will be used. In addition, the control means of the driving apparatus in some embodiments is made detachable from the driving unit so as to use one control means for multiple driving apparatuses (detachable or not from the ladders) provided without integrated control means, the detachable control means being connected to the driving apparatus of the ladder which will be used. The pulley which is driven by the motor in the driving apparatus is in fact fixed to the ladder and remains fixed to the ladder when the driving apparatus is moved between ladders. If desired, the driving apparatus can be left permanently fixed to the ladder and to its driven pulley, preferably the lower pulley as the driving apparatus is preferably arranged at the lower end of the ladder.

In a specific embodiment, the remote control, at its first end is directly connected with the carabineer 6 and the belt grab 5 to the traction cable 4 and at its second end is attached to the user, this arrangement replacing the lanyard.

The driving apparatus 2 with its bottom pulley also includes an electric motor, a gear drive, a sensor for detecting the rotation of the bottom pulley or motor shaft and control means in the form of an electronic/CPU board system. Preferably, the driving apparatus 2 is removably attached to the ladder and can be displaced to another ladder if needed. It is powered by the main electric grid: 220V to 240V 50 Hz in Europe for example.

The sensor is a rotational sensor which gives binary pulses when the cable (in fact the user) is in movement. The time characteristics of the pulses (frequency and period and on time-off time) are in relation to the rotation of the pulley or motor shaft of the driving apparatus. Preferably the rotational sensor is a switch activated by a toothed path of the pulley or motor shaft of the driving apparatus. In another embodiment, the sensor is on the output shaft of the gear box/drive opposed to its input shaft connected to the motor. The sensor gives 4 pulses per revolution of the pulley and if the detection of a movement can be asserted by a first transition (on to off or off to on) of the switch sensor, for the detection of no movement a time limit is given and when no pulse or transition is detected within that time limit then no movement is asserted.

Preferably, as for the detection of movement or the detection of no movement, time limits are given and pulses are counted within those time limits: if the number of pulses is greater than a threshold the movement is asserted else, no movement is asserted.

The user is also attached to an independent fall protection system 10 supplied on the ladder 1. After being attached to the belt grab 5 carabineer 6 and to the independent fall protection system 10, the climber can proceed with the assistance device.

First, after switching on the assistance device, the user has to enter his weight into the assistance device through the remote control so as to inform the control means of the levels of assistance to provide to the user. The remote control 12 has three buttons: "stop" 13, "up" 14 and "down" 15 and a display 16. To enter his weight, the Climber will push and hold the "stop" button on the remote control, and same time press "up" or "down" button for increasing or decreasing the displayed weight till the correct weight is displayed and at that time he release (all) the button(s) so that the entered weight is transmitted to the control means in the driving apparatus. The display of the remote control is preferably of the LCD type. The assistance device allows displays and selection of weight in 10 lb increments from 100 to 300 lbs. The assistance level on climb is approximately 45% to 75% of the weight entered and counterforce of approximately less than 25% on the decent. On climb, preferably, the level of assistance is approximately 65% for the heaviest users and 60% for the lighter ones. The level of assistance at least on climbing up is then a function of the weight entered by the user, the heaviest users receiving more assistance than the others.

Once the weight has been entered in the assistance device, the press of direction key, "up" or "down", will activate the assistance device for the requested direction. Activation means that the motor is powered. During motor operation, the current applied to the motor is controlled in a regulation closed loop: the control means drives the motor under determined constant torque by monitoring current and/or voltage and which level depends of the assistance level determined by the assistance device according to its programmed algorithm/program and storage table of sets of values of level of assistance. In other embodiments, the torque is controlled in a variable manner. The motor may be a DC or AC motor or even a step motor. The "stop" button is for deactivating the assistance device and thus to stop powering the motor. In all cases of activated assistance, whatever the selected direction, the motor is activated for pulling the user. However, the levels of assistance and the way the assistance device will react to the user movements or no movement will be different according to the selected direction as this will be explained more precisely thereafter.

As a general example of operation of the assistance device, the system will continue to be activated while the user is moving along the ladder in the selected direction. However, the assistance device will be deactivated if at least one of the following conditions takes place:

- the "stop" button is pressed on the remote control and this means that the user will need to press "up" or "down" button to start the system again,
- the user stops the climb or descent (with a possible intermediate low level of assistance if the user was on a high level of assistance when he stopped),
- if the signal from the remote control is lost for a predetermined duration,
- the emergency stop button of the driving apparatus is pushed,
- if cable over speed is detected.

When deactivated, the assistance device will need to be activated again by pressing one of the activation buttons of the remote control.

The assistance device is designed for the remote control to have one of 9999 preset codes as to allow specific communication between the remote control and the driving apparatus without interfering with other remote control/driving apparatus having not the correct code preset. In order to reduce power drain in the remote control, communication is broken when stop button is pressed (manual deactivation) or two minutes after climber has stopped (which also caused deactivation). In addition, the backlit LCD display automatically shuts off after two minutes of non use of key(s), also saving battery life of the remote control.

The remote control and driving apparatus exchanges are wireless with an average range of 100 meters, an antenna being mounted on the exterior of the enclosure of the driving apparatus 2. The wireless is compliant with EN300 328 and EN 300 440 class 2 (Europe), FCC CFR47 Part 15 (US). For protecting the remote control, it is in a plastic case with a rubberized cover. Preferably, the remote enters a "sleep" mode if it is inactive for five minutes.

In order to reduce power drainage in the remote control, the remote control will communicate continually for as long as motion is detected or if the user is pressing buttons on the remote. If no motion or no activity is present, the communications will stop after 10 seconds. Moreover, notably at switch on of the assistance device, the remote will continue attempting connection and will stop after 10 seconds and the Climb Assist will stop (switch off as it was not activated just after switch on for example) at that moment. It has to be noted that a different remote can communicate 10 seconds after communication has stopped with the first remote control Preferably, the remote control 12 is a passive device allowing transmission of identification of keyed/pressed buttons 13, 14, 15 and reception and display of values relative to a weight on the display 16 and the control means of the driving apparatus manages the entry of the weight with the remote control. In another embodiment, the remote control is active, having some programmable means and the entry/input of the weight is managed by the remote control and it sends to the control means of the driving apparatus the entered weight. In an embodiment, the remote control has also three LED to indicate the activation choice previously done: "Up", "Down" (the selected LED is lid off when the stop button is pressed and, preferably, also, when the activation is deactivated whatever the cause) and also "Low Battery".

Figure 2:
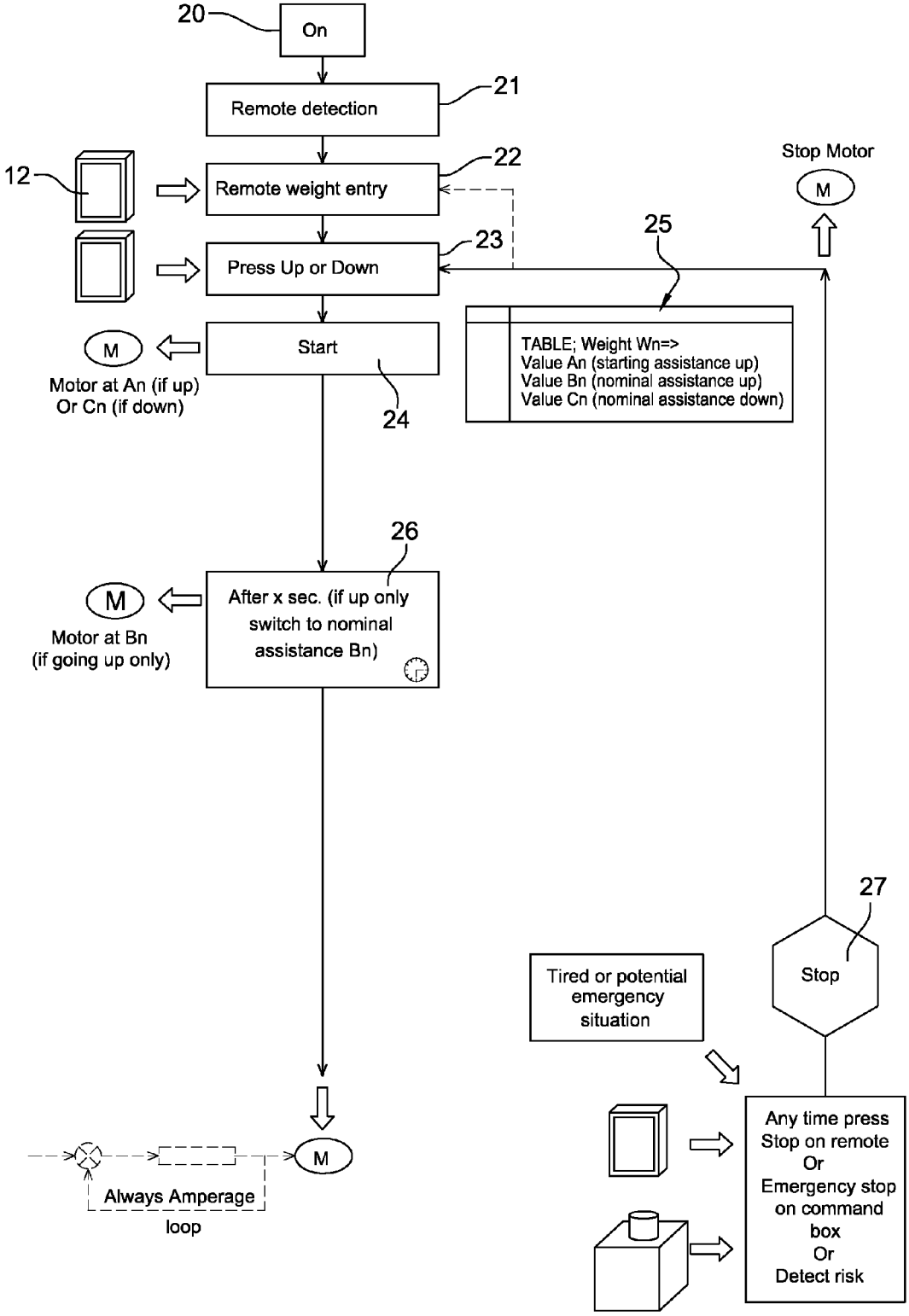
FIG. 2 is a first functional diagram of operation of an embodiment of the invention.

FIG. 2 is a general functional diagram/flow chart of an example of an embodiment of an assistance device according to the invention and corresponding to a program in the control means. When the assistance device is powered ON, it is in a deactivated state. When the user uses the remote control, this is detected 21 by the control means of the driving apparatus and it waits for the weight to be entered 22. No activation is possible without an entered weight. After the weight has been entered, the control means waits for an activation corresponding to one of the "up" or "down" buttons to be pressed 23. Activation starts 24 the motor with a level of assistance determined by the selected button on the remote control and thus the selected direction by the user. The levels of assistance are predetermined and stored as sets of control values in a memory of the control means. There are as many sets of control values corresponding to assistance levels as there are possible weights. The control values being predetermined there is no need to compute them in the assistance device. The CPU means of the assistance device can thus be much simpler than systems in which the assistance level should be calculated each time according to variables such as the weight or other. In the current invention, this is only a matter of fetching in the memory of the control means the set of control values corresponding to the entered weight entry. Once this set is found it is then a matter of using the control value corresponding to the selected direction of movement (the "up" or "down" key initially pressed for activating the assistance device) and the current conditions detected by the sensor of the driving apparatus as defined in the programmed algorithm/program of the control means.

In the example of FIG. 2, the sets of control values are stored in a table 25 and each set (corresponding to a specific weight) has three control values: a "up" base control value An for a base level of assistance in the "up" direction, a "up" nominal control value Bn for a nominal level of assistance in the "up" direction, a "down" main control value Cn for a main level of assistance in the "down" direction. The "up" base control value gives a level of assistance lower than the one given by the "up" nominal control value, this last one giving an assistance pulling force of approximately 45% to 75% (preferably 60% to 65%) of the entered user weight. The "down" main control value gives an assistance pulling force of approximately less than 25% of entered user weight Given the selected activation button in 24, if "up", the control means activates the assistance device with a level of activation corresponding to the An "up" base control value of the table for the entered weight. If it was "down" button, then the Cn "down" main control value would have been used.

Now in 26, if "up" was selected and the user is still climbing after a few x seconds (for example x=5 seconds) the level of assistance has been set with the An "up" base control value, the control means changes the level of assistance to a higher one corresponding to the Bn "up" nominal control value.

In this embodiment, if "down" was selected, the level of assistance is set according to the Cn "down" main control value and remains set to that level while the user is descending and there is no change of level of assistance to another one as it is done for the "up" selection. In another embodiment, there could be a change of level for the "down" selection as it is done for the "up" selection.

Preferably, any change of level of assistance is ramped over a duration which is more or less long depending of the urgency of the modification. For example, in case a deactivation is requested for over speed, the duration of the ramp for decreasing to null the level of assistance is short or even a zero duration. Ramping from deactivated to activated (set to "up" base control value or "down" main control value according to the selected direction on the remote control) or between "up" base control value and "up" nominal control value could be lengthier.

In all cases, deactivation 27 can be obtained by pressing "stop" button on the remote control, pressing an emergency stop button on the driving apparatus or in case of a detection of a risk such as over speed. Other deactivation conditions can be considered such as a movement of the user which is contrary to the one selected on the remote control or because the signal from the remote control is lost for some time (this could be due to battery exhaustion or another problem with the remote control or the communications between the remote control and the control means of the driving apparatus) for example.

Figure 3:
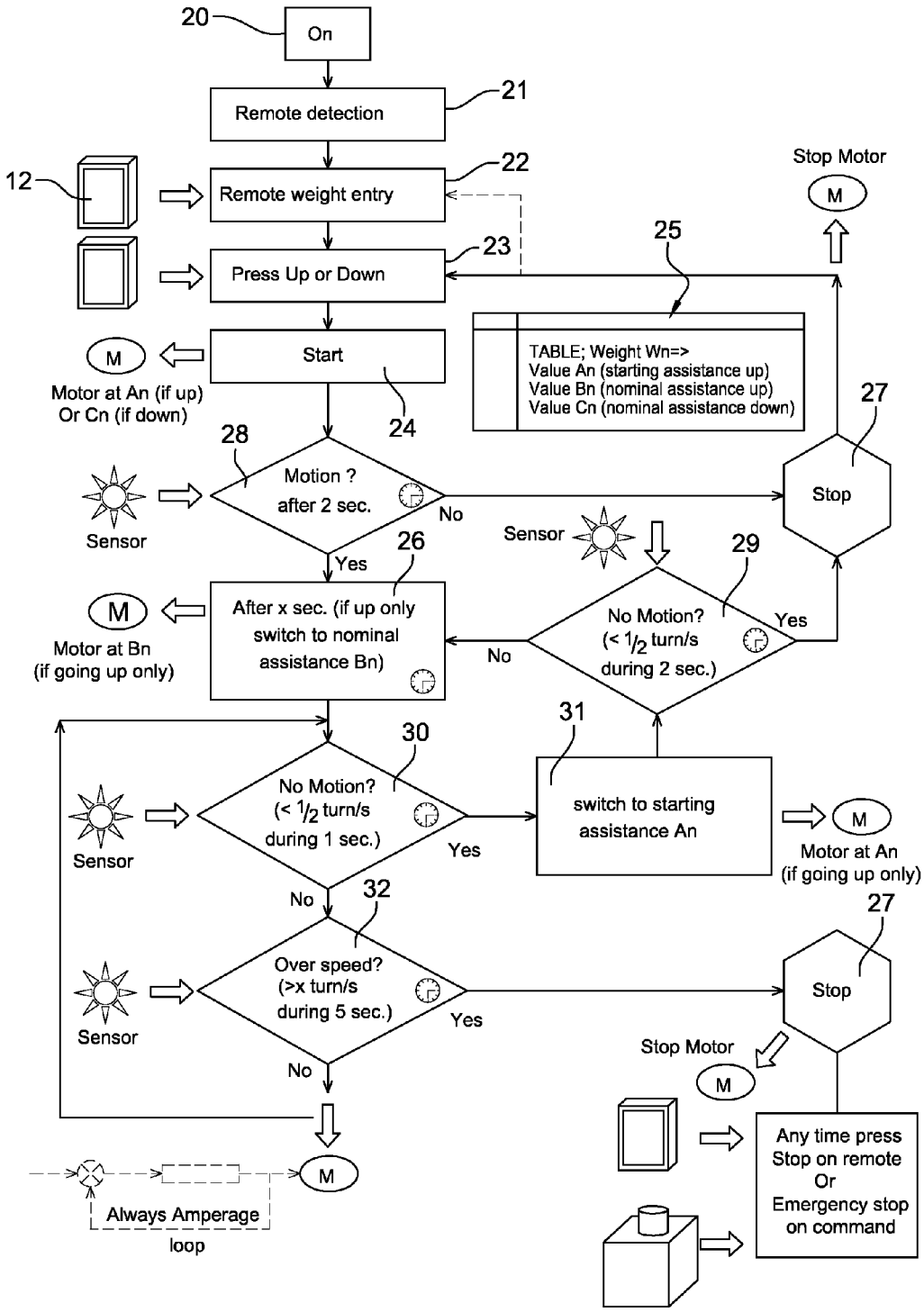
FIG. 3 is a second functional diagram of operation of an embodiment of the invention.

FIG. 3 is a more detailed functional diagram of operation of an embodiment of an assistance device according to the invention. As for the embodiment of FIG. 2, when the assistance device is powered ON, it is in a deactivated state. When the user uses the remote control, this is detected 21 by the control means of the driving apparatus and it waits for the weight to be entered 22. If a previous entered weight is available in the assistance device for the user of the remote control, there is no need for him to reenter it each time. However, he may enter a new weight if needed (for example he has, for that time, to carry some heavy tools).

After the weight has been entered, the control means waits for an activation corresponding to one of the "up" or "down" buttons to be pressed 23. Activation starts 24 the motor with a level of assistance determined by the selected button on the remote control and thus the selected direction by the user. As previously, the sets of control values are stored in a table 25 and each set (corresponding to a specific weight) has three control values: a "up" base control value An for a base level of assistance in the "up" direction, a "up" nominal control value Bn for a nominal level of assistance in the "up" direction, a "down" main control value Cn for a main level of assistance in the "down" direction.

Given the selected activation button in 24, if "up", the control means activates the assistance device with a level of activation corresponding to the An "up" base control value of the table for the entered weight. If it was "down" button, then the Cn "down" main control value would have been used.

If after 2 seconds there is no motion 28 then the assistance device is deactivated 27 and thus the motor stopped.

If after 2 seconds there is still motion in the selected direction, a further test is done after the following seconds. In that test, if "up" was selected and the user is still climbing, the control means changes the level of assistance to a higher one corresponding to the Bn "up" nominal control value.

In this embodiment, if "down" was selected, the level of assistance is set according to the Cn "down" main control value and remains set to that level while the user is descending and there is no change of level of assistance to another one as it is done for the "up" selection. In another embodiment, there could be a change of level for the "down" selection as it is done for the "up" selection.

In all cases, deactivation 27 can be obtained by pressing "stop" button on the remote control, pressing an emergency stop button on the driving apparatus or in case of a detection of a risk such as over speed as represented on the test referenced 32 of FIG. 3. Other deactivation conditions can be considered such as a movement of the user which is contrary to the one selected on the remote control for example or the detection of no movement of the user when the assistance device is activated as represented with the tests 29 on FIG. 3.

More precisely, when the level of assistance has been set with the "up" nominal control value Bn and that there is a detection of no movement in test 30, then the program of the control means lowers the level of assistance by using 31 the "up" base control value An of the table for the entered weight. Then at that lower level of assistance with An, if there is still no movement detected in 29, then the control means deactivates 27 the assistance device. On the contrary, if after x seconds (for example 5 seconds) there is still movement in the "up" direction detected in 26, then the control means increases again the level of assistance with Bn "up" nominal control value. As a consequence, for the "up" direction selected and climb of user, the highest assistance level Bn is not given at once but only after a lower level An has been set for some time. This is also the case for deactivation when due to the end of movement of the user: from the highest level set by Bn the control means first lowers the assistance level to An for some time before deactivating if the person has stopped movements. For other causes of deactivation, notably by pressing the stop button (on the remote or the urgency one on the drive apparatus) or over speed detection, the deactivation is immediate (with a possible ramping) without any intermediate level of assistance An.

According to another embodiment, after the assistance device is switched on (or after a deactivation of the assistance device) a regular pull corresponding to "up" base level of assistance, given by An, will start if "up" button was pressed on the remote control. Now if the user stops and then moves the cable immediately after, either manually or by continuing to climb, the assistance device will automatically provide a regular pull corresponding to "up" base level of assistance. As a general rule in this embodiment, this regular Pull stops (that is the motor is switched off) if no motion is detected for 2 seconds or if the user presses the "Stop" button on the remote control. In additions, an assistance boost corresponding to the "up" nominal level of assistance, given by Bn, starts if fast climbing is detected. When the assistance device is in the boost mode, boost will stop if the user presses the "Stop" button on the remote control. The assistance device will change of level of assistance when in boost mode if slow climbing is detected or if no motion is detected for 1 second.

The previous description is not intended for limiting the scope of the invention which is only limited by the appended claims. In particular, equivalents of structural or functional means are also considered within the scope of the invention. In particular, the various examples of operations or parts of those operations are combined in all functional embodiments available. For example the test of a slow motion can be implemented when in an "up" nominal level of assistance to reduce it to an "up" base level of assistance instead or in addition to a no motion test.

The invention claimed is:

1. A device to assist utilization of a ladder, comprising:

a controlled driving apparatus;

a cable pulled by the controlled driving apparatus, the cable being laid in a loop along a height of the ladder;

a lanyard attached to the cable for attachment to a user;

a sensor disposed in the driving apparatus to detect movements of ascent or descent of the user along the ladder;

a controller with a determined control program connected to the sensor, the controller being configured for controlling the controlled driving apparatus of the cable according to movements of the user so that when the device is assisting the user, the controlled driving apparatus being configured to drive the cable with determined assistance levels corresponding to pulling forces which are lower than a force of gravity of a weight of the user;

a remote control configured for activation or deactivation of the assistance and also allowing the manual input of the weight of the user, the remote control optionally being attached to the lanyard; and the remote control comprising a stop button configured for deactivation of assistance, when deactivated no assistance is provided, and first and second activation buttons configured for activation of the assistance, the first activation button configured being for selecting an up direction for when wanting assistance on climbing and the second activation button being configured for selecting a down direction for when wanting assistance on descent;

the remote control also comprising a display configured for displaying weight values, said displayed weights values being increased or decreased or selected by the up, down and stop buttons;

a memory configured for storage of sets of assistance control values for the control of the assistance level(s) of the driving apparatus by the controller, the assistance level(s) for the up direction of movement corresponding to two levels of assistance and for the down direction of movement corresponding to at most two levels;

each set of assistance control values being for a given weight and having for an up direction selection two assistance control values, a base assistance control value for the up selection, a nominal assistance control value for the up selection, the base assistance control value giving a lower assistance level than the nominal assistance control value, the lower assistance level being not null, wherein the program of the controller having material elements allowing:

selection among the sets of the one that corresponds to the weight entered in the device with the remote control, activation of the assistance which is only obtained by the activation buttons of the remote control, the activation buttons allowing the start of assistance to a level set to the base assistance control value for the selected direction, deactivation of the assistance which is obtained by either the stop button of the remote control, or by the detection by the sensor of no movements, or by the detection by the sensor of an actual direction of movement opposite to the activation button which was selected, and the program of the controller further allowing for the up selected direction:

following a predetermined time after the level assistance has been set to the up base assistance control value, if the sensor detects a movement in the up selected direction then the level of assistance is set to the up nominal assistance control value, else being the deactivation of the assistance, when the level assistance has been set to the up nominal assistance control value, if the sensor detects no movement or a slow movement then the level of assistance is set to the up base assistance control value.

2. The device according to claim 1, wherein the program of the controller allows in addition deactivation of the assistance when, after having selected a button for a given direction and thus activated the assistance device, an opposite direction button is selected.

3. The device according to claim 2, wherein the device, optionally in the controller, comprises the memory for storage of sets of assistance control values for the control of the assistance levels of the driving apparatus by the controller, the assistance level(s) for each direction of movement, up or down, corresponding to two levels in a steady state of the assistance, each set of assistance control values being for a given weight, the two levels for each selected direction being given by a base assistance control value and a nominal assistance control value, the base assistance control value giving a lower assistance level than the nominal assistance control value, the lower assistance level being not null, each set thus having four assistance control values, the program of the controller further allowing for each direction selection:

following a predetermined time after the level assistance has been set to the base assistance control value, if the sensor detects a movement in the selected direction then the level of assistance is set to the nominal assistance control value else being the deactivation of the assistance, when the level assistance has been set to the nominal assistance control value, if the sensor detects no movement or a slow movement then the level of assistance is set to the base assistance control value.

4. The device according to claim 2, wherein the controller comprises the memory for storage of sets of assistance control values for the control of the assistance level(s) of the driving apparatus by the control means, the assistance level(s) for the selected up direction corresponding to two levels in the steady state of the assistance for climbing of the user, the assistance level for the selected down direction corresponding to one level in the steady state of the assistance for descent, each set of assistance control values being for a given weight, the two levels for the selected up direction being given by an up base assistance control value and an up nominal assistance control value, the up base assistance control value giving a lower assistance level than the up nominal assistance control value, the lower assistance level being not null, the level for the selected down direction being given by a down main assistance control value, each set thus having three assistance control values;

and in that the program of the controller allows for the down selected direction:

when the level assistance has been set to the down main assistance control value, if the sensor detects no movement then the assistance is deactivated.

5. The device according to claim 2, wherein the assistance level given by the up nominal assistance control value is approximately 75% of the entered weight for a heaviest of the users and approximately 45% for lighter ones.

6. The device according to claim 2, wherein the controller comprises a component allowing to gradually modify over a first predetermined time the action of the driving apparatus at least at start of assistance and when the assistance control values change between up base and up nominal assistance control values.

7. The device according to claim 1, wherein the device, optionally in the controller, comprises the memory for storage of sets of assistance control values for the control of the assistance levels of the driving apparatus by the controller, the assistance level(s) for each direction of movement, up or down, corresponding to two levels in a steady state of the assistance, each set of assistance control values being for a given weight, the two levels for each selected direction being given by a base assistance control value and a nominal assistance control value, the base assistance control value giving a lower assistance level than the nominal assistance control value, the lower assistance level being not null, each set thus having four assistance control values, the program of the controller further allowing for each direction selection:

following a predetermined time after the level assistance has been set to the base assistance control value, if the sensor detects a movement in the selected direction then the level of assistance is set to the nominal assistance control value else being the deactivation of the assistance, when the level assistance has been set to the nominal assistance control value, if the sensor detects no movement or a slow movement then the level of assistance is set to the base assistance control value.

8. The device according to claim 7, wherein the assistance level given by the up nominal assistance control value is approximately 75% of the entered weight for a heaviest of the users and approximately 45% for lighter ones.

9. The device according to claim 7, wherein the controller comprises a component allowing to gradually modify over a first predetermined time the action of the driving apparatus at least at start of assistance and when the assistance control values change between up base and up nominal assistance control values.

10. The device according to claim 1, wherein the controller comprises the memory for storage of sets of assistance control values for the control of the assistance level(s) of the driving apparatus by the control means, the assistance level(s) for the selected up direction corresponding to two levels in the steady state of the assistance for climbing of the user, the assistance level for the selected down direction corresponding to one level in the steady state of the assistance for descent, each set of assistance control values being for a given weight, the two levels for the selected up direction being given by an up base assistance control value and an up nominal assistance control value, the up base assistance control value giving a lower assistance level than the up nominal assistance control value, the lower assistance level being not null, the level for the selected down direction being given by a down main assistance control value, each set thus having three assistance control values;

and in that the program of the controller allows for the down selected direction:

when the level assistance has been set to the down main assistance control value, if the sensor detects no movement then the assistance is deactivated.

11. The device according to claim 10, wherein the assistance level given by the up nominal assistance control value is approximately 75% of the entered weight for a heaviest of the users and approximately 45% for lighter ones.

12. The device according to claim 10, wherein the controller comprises a component allowing to gradually modify over a first predetermined time the action of the driving apparatus at least at start of assistance and when the assistance control values change between up base and up nominal assistance control values.

13. The device according to claim 1, wherein the assistance level given by the up nominal assistance control value is approximately 75% of the entered weight for a heaviest of the users and approximately 45% for lighter ones.

14. The device according to claim 13, wherein the controller comprises a component allowing to gradually modify over a first predetermined time the action of the driving apparatus at least at start of assistance and when the assistance control values change between up base and up nominal assistance control values.

15. The device according to claim 1, wherein the controller comprises a component allowing to gradually modify over a first predetermined time the action of the driving apparatus at least at start of assistance and when the assistance control values change between up base and up nominal assistance control values.

16. The device according to claim 1, wherein the deactivation is also obtained by the detection by the sensor of movement corresponding to an over speed of the cable for both directions.

17. The device according to claim 1, wherein the driving apparatus comprises an electric motor, a gear drive, a pulley, the sensor and the controller, the sensor is a rotational sensor for detection of the rotation of the pulley or on the motor shaft of the driving apparatus, said the rotational sensor giving binary pulses which time characteristics are in relation to the rotation of the pulley or motor shaft of the driving apparatus, said rotational sensor being optionally a switch activated by a toothed path of the pulley or motor shaft.

18. The device according to claim 1, wherein the driving apparatus is detachable from the ladder, and optionally the pulley driven by the motor remains fixed to the ladder.

19. The device according to claim 1, wherein the remote control has a display and that the device has active elements for, when the stop button and one of the two activation buttons of the remote control are both pressed, displaying on the remote control a numerical value corresponding to a weight, the displayed value increasing or decreasing when the up or down button respectively is pressed while the stop button is kept pressed, the last value displayed when at least the stop button is released being the selected weight.

20. The device according to claim 17, wherein the motor is a DC or AC or step motor.

* * * * *